US005117516A

United States Patent [19]

Penner

[11] Patent Number: 5,117,516

[45] Date of Patent: Jun. 2, 1992

[54] PATIENT SLING

[76] Inventor: Elmer Penner, 5909 N. Grantland, Fresno, Calif. 93722

[21] Appl. No.: 797,690

[22] Filed: Nov. 25, 1991

[51] Int. Cl.[5] ..... A61G 7/14; A61G 7/12

[52] U.S. Cl. ..... 5/86.1; 5/81.1

[58] Field of Search ..... 5/86, 81 R, 81 B, 83, 5/87, 89; 414/921

[56] References Cited

U.S. PATENT DOCUMENTS

| | | | |
|---|---|---|---|
| 2,891,256 | 6/1959 | Scully | 5/86 |
| 2,914,110 | 11/1959 | Schulte | 5/81.1 |
| 4,530,122 | 7/1985 | Sanders et al. | 5/81.1 |
| 4,574,410 | 3/1986 | Lassmann et al. | 5/81.1 |
| 4,704,749 | 11/1987 | Aubert | 5/81.1 |
| 4,918,771 | 4/1990 | James | 5/86 |
| 5,001,789 | 3/1991 | Schoenberger | 5/86 |
| 5,038,425 | 8/1991 | Merry | 5/86 |

*Primary Examiner*—Alexander Grosz
*Attorney, Agent, or Firm*—Beehler & Pavitt

[57] ABSTRACT

Means for lifting a handicapped or otherwise disabled person from a sitting position and moving such person to another area, as for a bath, use of a toilet or different seating, comprising an open torso support formed of a rigid transverse member, such member having an inner wall adapted to fit across the person's abdominal area, and a vertical outer wall supporting a pair of vertical elements spaced apart from each other and having rearwardly extending arcuate arm supports. The torso support is pivotally attached to lifting means such as a hydraulically constructed "cherry picker" lift, or an overhead lifting cable.

9 Claims, 4 Drawing Sheets

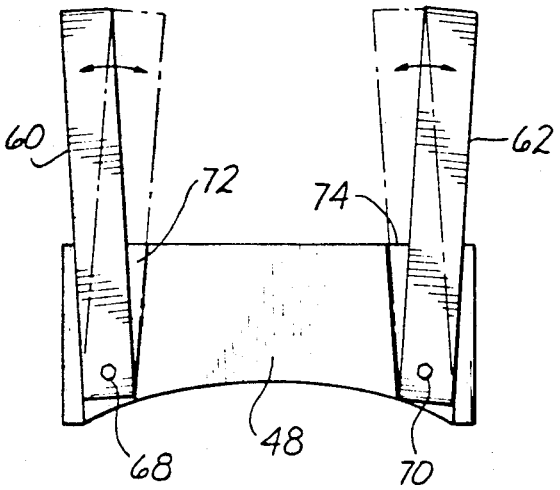
Fig. 4
Fig. 5
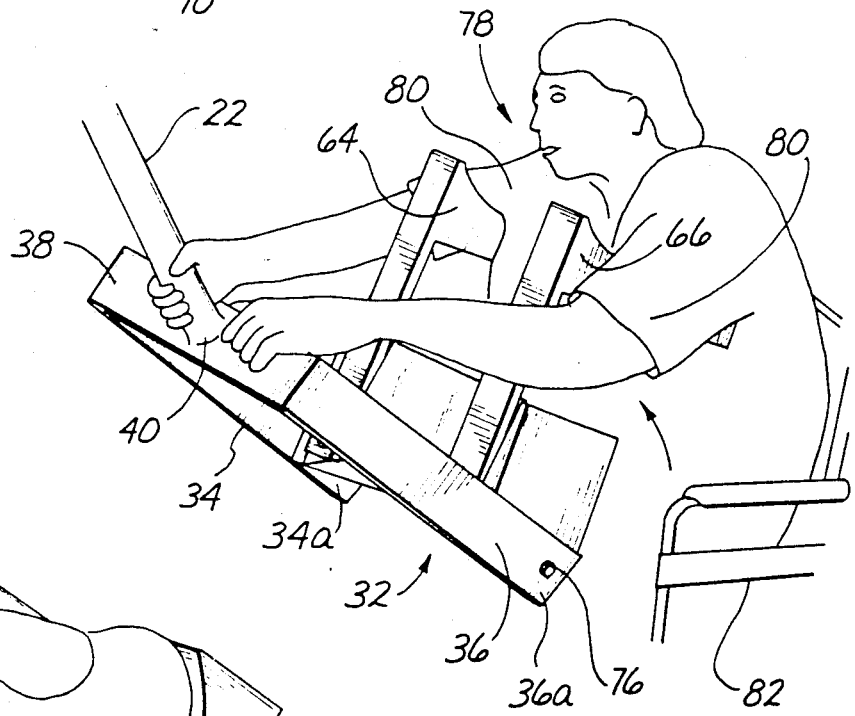
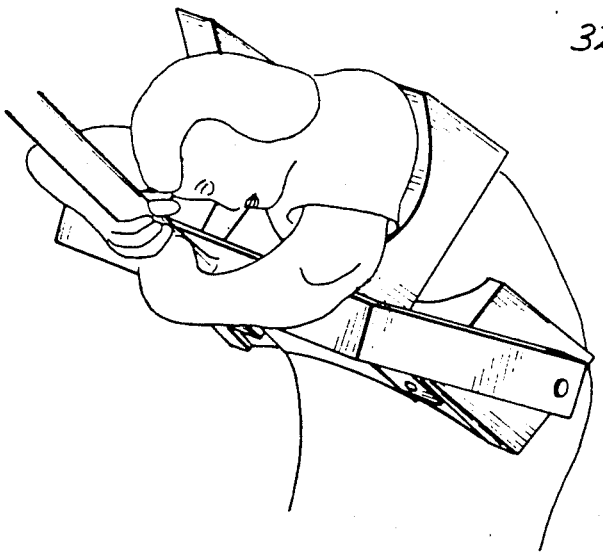
Fig. 6

PATIENT SLING

FIELD OF THE INVENTION

This invention falls in the field of lifting devices for certain types of handicapped or otherwise disabled persons, which devices are designed to enable such persons to be moved about from beds, wheelchairs and sitting chairs to bathtubs, toilets and wash basins, or to the other sitting or resting furniture. The invention may also be utilized for limb or body therapy or other forms of rehabilitation.

BACKGROUND OF THE INVENTION

For many decades, efforts have been made to provide means to lift and move patients who are not required by their conditions to remain in bed, as well as handicapped or other disabled persons, from their beds or seatings, to such facilities as toilets and bathtubs, both for their own comfort, as well as to lessen the burden of those, such as nurses and hospital orderlies, who may be charged with attending to the physical needs of such persons. When not so moved when the need requires, such patient or handicapped person must be provided with bed pans, urinating bottles and wash pans in order to keep the patient or other person clean or comfortable.

DESCRIPTION OF THE PRIOR ART

In order to accomplish the desired lifting and movement just described, a number of expedients have been devised, some examples of which are illustrated and described in the following patents:

| Patent Nos | Inventors |
|---|---|
| 5,038,425 | Donald D. Merry |
| 4,918,771 | David R. James |
| 4,704,749 | Benjamin A. Aubert |
| 4,530,122 | Robert C. & Donald M. Sanders |
| 4,574,410 | Dieter Lassman et al. |
| 2,914,110 | Frederick J. Schulte |
| 2,891,256 | Vincent Scully |

While the devices and/or arrangements of each of these patents may accomplish their particular objectives, each appears to be either somewhat complicated and, hence, expensive to manufacture, or not easily utilizable by the subject to whom it is to be applied. As a result, none of the devices and/or arrangements of these patents appears to have been widely adopted or marketed. In addition, none of the devices would be appear to be suitable for enabling such a handicapped person to be elevated to permit use of his or her own legs for supported walking.

What has been needed is a relatively inexpensive support which may be easily utilized by the patient or handicapped person and his or her attendant—or, depending upon the degree of disablement—by the person, alone, to provide some freedom for the person's lower body and legs.

SUMMARY OF THE INVENTION

The basic element of the present invention is a torso support comprised of a rigid member designed to receive and support the person's abdomen and remainder of the upper torso. Extending upwardly from each side of the forward wall of this member is a vertical element which itself supports a rearwardly extending partially arcuate arm to receive one of the patient's arms adjacent an armpit. Lift means are provided for pivotable attachment to the torso support at the rear of and outside each extremity of the rigid member. Such lift means may either be a hydraulic lift of the "cherry picker" type; or the lifting means may be in the form of two pairs of flexible elements, such as straps, ropes or cables, connected to a cable from some type of tracked trolley or other overhead lifting means. In the latter case, one pair of the flexible elements is pivotally attached at the rear and outside the extremities of the rigid member, and the second pair of flexible elements is secured to the tops of the vertical elements, in order to prevent the torso support from flipping over.

The torso support is brought into a position where the patient's abdomen is pressed against the inner wall of the rigid member and his or her armpits are seated in the arcs of the partially arcuate rearwardly extending arms. Where a "cherry picker" lift is employed, the patient may grasp the yoke of the base of the U-portion of the device which is attached to the torso support. Upon leaning forward the patient is then in a position to be raised by the jacking of the hydraulic lever of the "cherry picker". The latter may then be wheeled toward the bathroom or other area into which the patient is to be moved, providing the patient with either entire or partial support. Desirably, the patient's legs may extend down to where his or her feet are actually on the floor and, indeed, may attempt to provide some ambulatory support, or at least make an effort to do so. Upon reaching the desired destination, such as a toilet, the hydraulic jack may be lowered to permit seating of the patient.

Where ropes or cables are attached to the torso support from some overhead lifting means, the latter is worked to provide a similar elevation and lowering of the torso support for the patient.

A particular advantage of the support arrangement of the present invention over at least some of the prior patented devices lies in the fact that the portion of the body below the upper torso is left free, so that there may easily be removed any garment covering that portion of the body to permit use of the toilet, bathing or changing of clothes. Such removal of clothes and toilet use is not easily accomplished where the patient is lifted by means of a seat or body encompassing lifting device of the prior art patents.

Another advantage of the present invention lies in the fact that it obviates lifting strain on the part of nurses or others who may be attempting to assist the patient move up and out of a bed or chair to some other location, such as a toilet, thereby minimizing workman's compensation or other injury claims on the part of the nurses or others.

DESCRIPTION OF THE DRAWINGS

In the accompanying drawings,

FIG. 4 is a front elevation of the torso support;

FIG. 5 is a perspective view showing the torso support mounted between the arms of a "cherry picker" and initially being mounted by a patient;

FIG. 6 illustrates the manner in which the patient then moves forward and is lifted by the "cherry picker";

FIG. 7 is a side schematic view of the torso support attached by flexible elements to the lower end of a cable;

FIG. 8 is a perspective view similar to FIG. 3, but showing the manner in which the flexible elements may be attached to the torso support for connection to the cable as shown in FIG. 7.

DESCRIPTION OF THE PREFERRED EMBODIMENT

Figure 1:
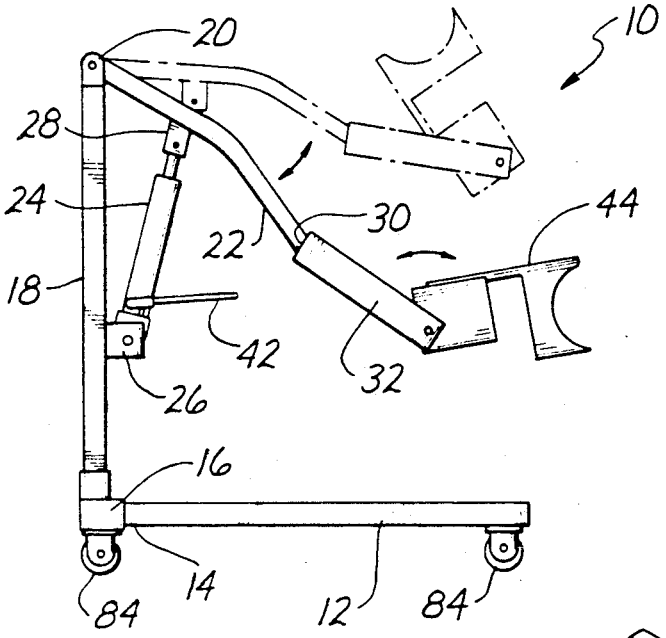
FIG. 1 is a side elevation, partly in phantom, of the invention employed with a "cherry picker" type lifting device.

FIG. 1 of the drawings illustrates the manner in which the present invention may be employed with a simple mobile hydraulically actuated device 10 sometimes referred to as a "cherry picker". Such a device 10 may comprise a pair of lower frame members 12 spaced apart from each other (not shown) and connected together at their forward extremities 14 by a transverse member 16. Some type of vertical element or elements 18 extend upwardly from the transverse member 16 to provide, at the upper extremity 20, a pivotable connection thereto of a hydraulically actuated arm 22. Such actuation may be provided by a hydraulic piston cylinder combination 24 which is interposed between a lug 26 fixedly secured to the vertical element 18 and a second lug 28 on the arm 22. The arm 22 may be centrally connected at 30 to a U-shaped frame 32 more fully shown in FIG. 5.

The U-shaped frame 32 may comprise a pair of parallel arms 34 and 36, the forward ends of which are fixedly connected to the transverse member 38 to which the arm 22 is secured at 40. A lever 42 may be provided to serve as a means for operating the hydraulic piston cylinder combination 24 to raise or lower the arm 22.

Figure 2:
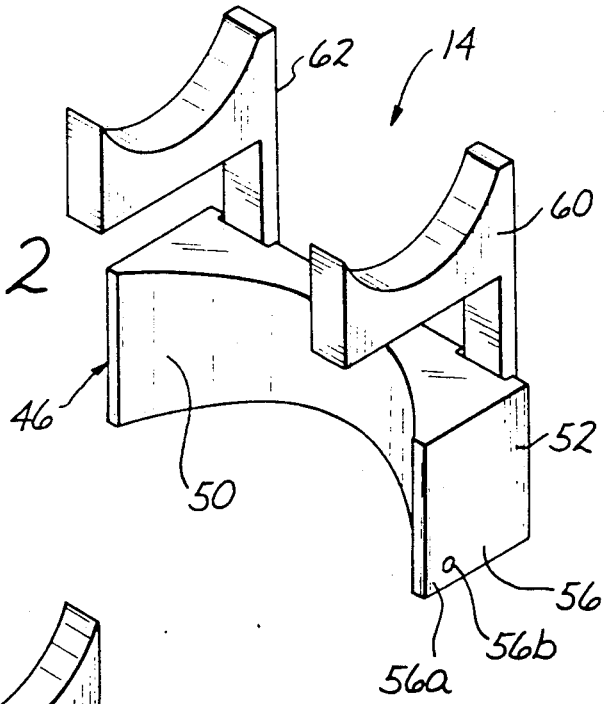
FIG. 2 is a perspective view of the torso support looking at it from one side and the rear.
Figure 3:
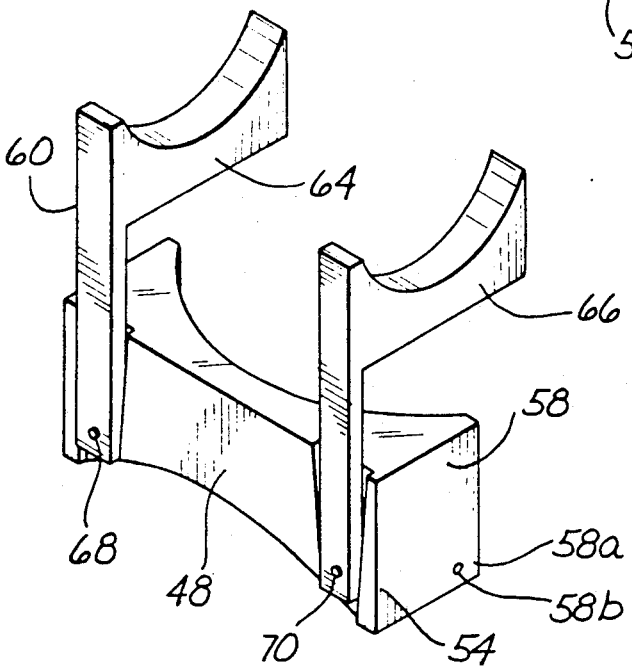
FIG. 3 is a perspective view of the torso support looking from the opposite side and the front.

The "cherry picker" 10 per se is of the type which is well known and has had many different types of uses, and is not an invention of the present applicant. The manner in which it is used, however, in conjunction with the torso support 44 which is about to be described, does constitute an invention of the present applicant. Referring to FIGS. 2, 3 and 4 of the drawing, the torso support 44 is comprised of a transverse member 46 having a vertical forward wall 48 and an inner wall 50 which, preferably, may be arcuate. The height of the wall 50 should approximate the dimension of the height of the average person's abdomen, i.e., the area between the hip bones and the lower portion of the rib cage, or between 7 and 9 inches. The forward wall 48 of the member 46 desirably may be generally planar, although it could be somewhat arcuate, i.e., either slightly concave or convex. Extending rearwardly at right angles from the side extremities 52, 54 of the forward wall 48 are a pair of vertical planar side walls 56 and 58. The member 50 should be formed of a material which is rigid and of sufficient strength to carry most of the weight of even a heavy person, e.g. as much as 400 lbs.

The torso support 44 further comprises a pair of rigid vertical support elements 60, 62 each of which is formed with a rearwardly extending arcuate arm support member 64, 66 respectively. Each vertical element 60, 62 is preferably pivotally attached at one side of the forward wall 48, at 68, 70, respectively. In order to permit limited angular rotation about the pivot points 68, 70, as best shown in FIG. 4, the forward wall 48 may be recessed at 72, 74 respectively.

In use with the cherry picker 10, the outer extremities 34*a*, 36*a*, of the arms 34, 36 respectively are pivotally connected by pins 76 to the lower rear corners 56*a*, 58*a*, of the planar side walls 56, 58 respectively. The cherry picker arms 34, 36 with the thus pivotally attached torso support 10 is advanced toward the patient 78 to where the patient may then place the arcuate arm supports 64, 66 under her upper arms and lean forward to grasp the member 22, as shown in FIG. 5. Upon then leaning forward somewhat as shown in FIG. 6, when the lever 42 is operated to jack up the piston cylinder combination 24, the member 22 will then be elevated in the manner shown in phantom in FIG. 1, thereby lifting the patient 78 out of the chair 82 or other seating position. The cherry picker 10 with the thus supported patient 78 may then be rolled by means of the wheels 84 to any other location such as a bed, toilet, bath, tub or a different seating location, either with or without any ambulatory support which may be provided by the patient's legs should the patient desire to utilize his or her legs for such ambulatory support.

The torso support 10 may also be employed with an overhead cable lifting-type device in the manner shown in FIG. 7. When so utilized, a cable 88 which may be raised or lowered by a pulley wheel 90 may be supported by some type of trolley 92 which runs on a track 94. In this arrangement, a cable connector 96 is provided to which two pairs of straps 98 and 100 may be clipped. The pair of straps 98 provide the basic support by pivotal attachment to the lower rear corners 56*a*, 58*a*, of the planar side walls 56, 58, while the straps 100 are attached near the upper extremities 102, 104 of the vertical elements 60, 62 respectively, in order to prevent the possibility of the patient 78 tipping too far forward about the pivot points 56*b*, 58*b*.

The application of the invention to the cable trolley system illustrated in FIG. 7 may be particularly useful where it is desired to develop strength in a person's legs after some type of surgery or other medical treatment since the cable 88 may be lowered by degrees to place only as much weight upon the patient's legs as desired by the physician or therapist, and the patient may be coaxed into trying to walk along a straight line.

Figure 9:
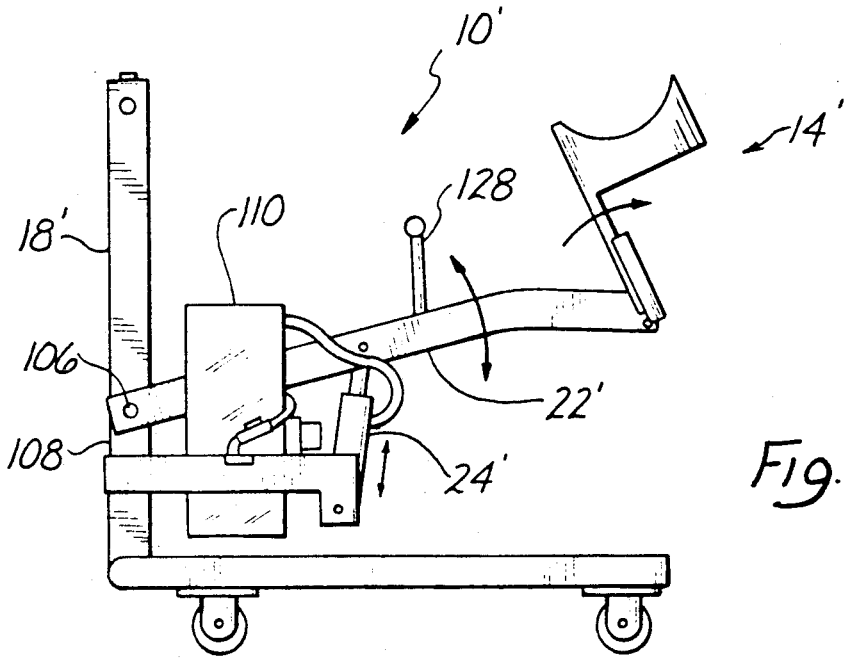
FIG. 9 is a side elevation similar to FIG. 1 of a modified embodiment of the invention.
Figure 10:
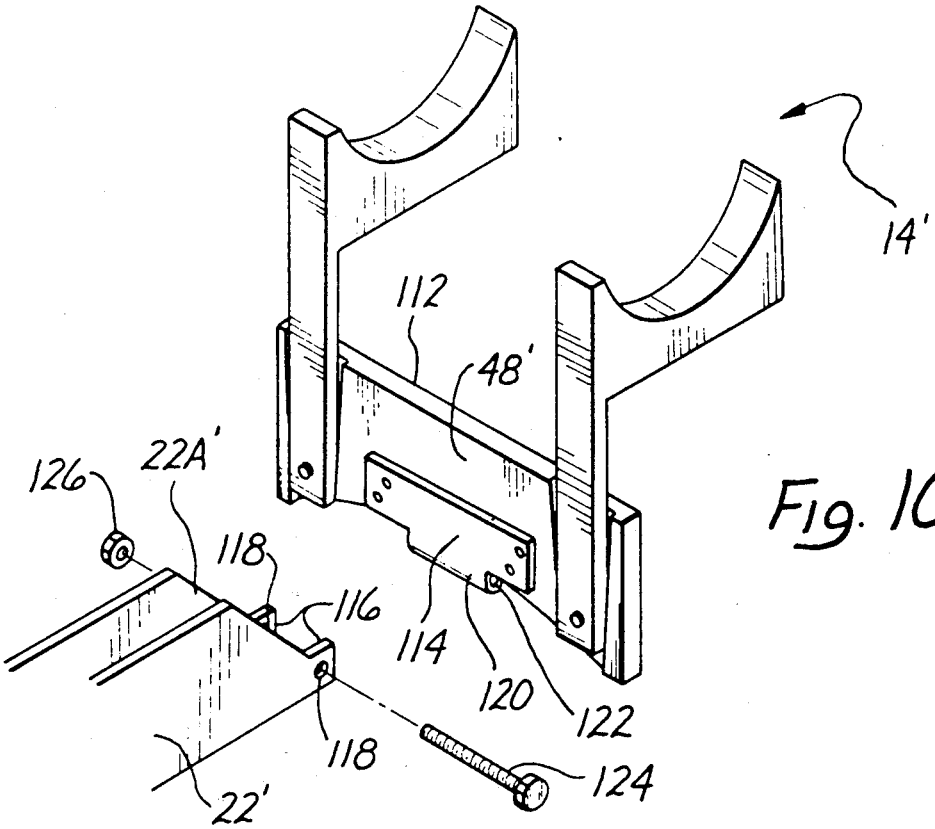
FIG. 10 is a perspective view similar to FIG. 3 illustrating the modified torso support and the manner of its hinged attachment to a different type of lifting arm.
Figure 9:
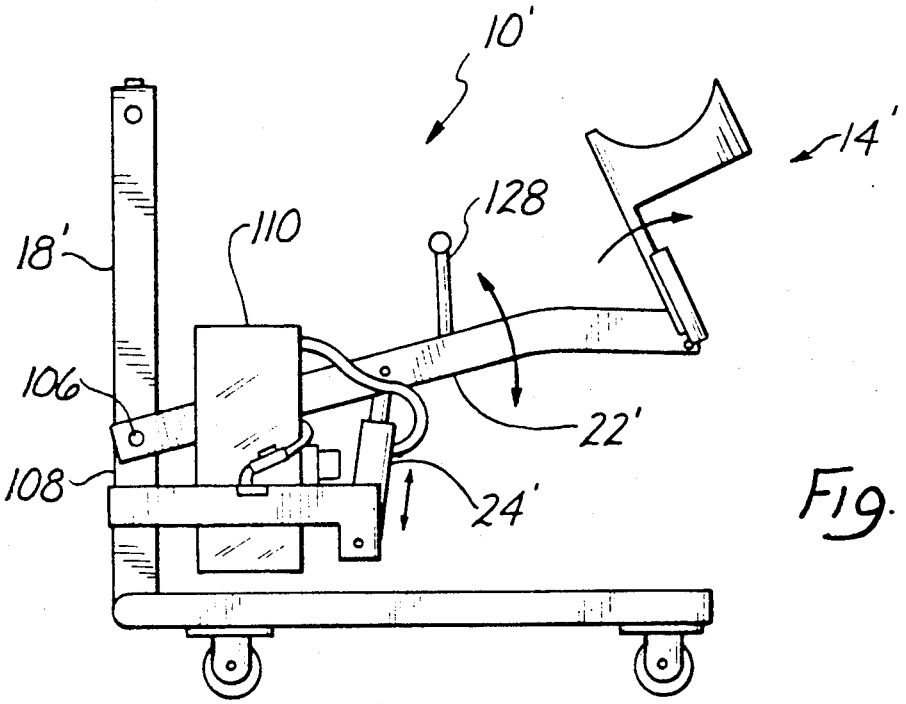
Figure 10:
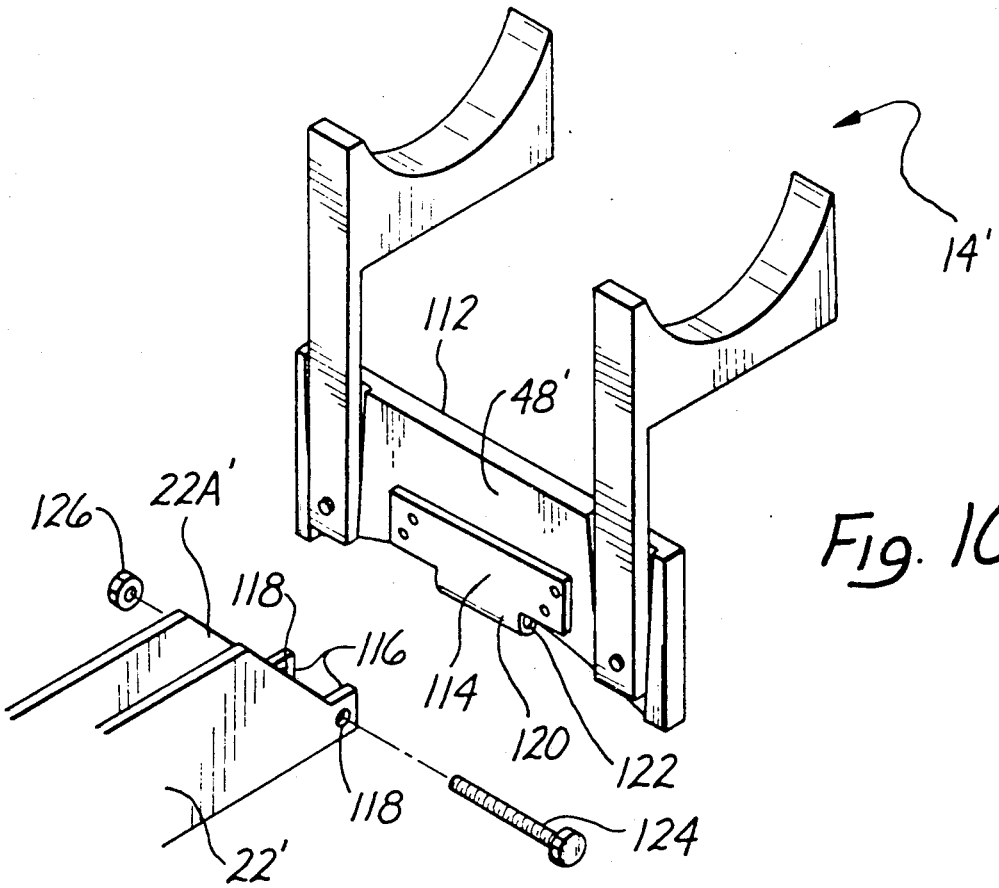

The preferred embodiment of the invention is illustrated in FIGS. 9 and 10 of the drawings. In this embodiment it may be seen that the mobile hydraulic device ten' differs somewhat from that shown in FIG. 1. Thus in FIG. 9 the arm 22' is pivotally connected at 106 to a lower point 108 on the vertical element 18' to be raised or lowered by a hydraulic piston cylinder combination 24' actuated by fluid from a pump 110.

As may be seen from a comparison of FIGS. 3 and 10 the torso support in the FIG. 10 embodiment may be comprised of a simple flat plate-like transverse element 112, having hinge means 114 on its forward wall 48'. In contrast to the bifurcated attaching means 34 and 36 shown in FIG. 5, the arm 22' at its forward end 22A' may be bifurcated to produce a pair of spaced apart lugs 116 having coaxial openings 118 adapted to encompass the ends of an orificed lower extension 120 of the hinged means 114. The orifice 122 of the extension 120 may thus be coalligned with the openings 118 to receive a bolt 124 which when passed through the openings 118 and the orifice 122 may be secured against withdrawal by a nut 126.

For the convenience of the person being lifted, a handle 128 may be fixedly secured at its base to the arm 22'.

It will be appreciated that the necessary swinging movement for the torso support 14' in the embodiment of FIGS. 9 and 10 may be accomplished through the hinging means 114 directly at the forward end of the arm 22', in contrast to the swinging movement for the embodiment of FIG. 1 through 6 about the pivoting attachment points **56*b* and 58*b*. Further, because the arm 22' is not bifurcated in the manner shown in FIGS. 5 and 6, the mobile device 10' may be made to occupy less space and be of lesser weight than that of the embodiment of FIGS. 1 through 6**.

It will be noted that with the torso support 10 of the present invention, the lower body portion of the patient is left free. This enables either the patient or the person caring for the patient to remove and/or change any garments which are applied to the lower body portion of the patient and, further, to enable the lower body portion to use a toilet or bathing facility and to be washed.

The present invention is quite simple and inexpensive to construct and, as is illustrated and explained, may be utilized either with a cherry picker type lifting device or an overhead cable or other overhead suspension arrangement.

I claim:

1. Means for lifting and providing mobile support to move a disabled or otherwise handicapped person from a bed or seating to another location, such as a bathroom, said means comprising:

(a) a torso support, said support being formed of (i) a rigid transverse member having an arcuate inner wall and a vertical outer wall terminating laterally in a pair of right angularly joined rearwardly extending planar side walls, said inner wall being dimensioned to extend from one side of the person's body to its other side around the abdominal area, and having a height generally conforming to the altitude of such area;

(ii) a pair of rigid vertical parallel support elements, each being secured to and extending upwardly from one side of said member, each of said vertical elements having extending rearwardly from its upper extremity, and rigidly supporting, an arm parallel to the arm of the other vertical element, each said arm being arcuately recessed downwardly to receive one of the body's arms at its torso connection; and (b) lifting means, said means being pivotally connected at the lower rear area of said planar side walls of said rigid member, said lifting means including means to prevent said torso support from flipping over about its pivotal connection on said planar side walls, and said lifting means being adapted to provide a force to raise and lower said torso support when the upper torso of a person is disposed therein with its armpits in the arcuate recesses of the arms extending rearwardly from the upper extremities of the vertical elements, and the abdomen pressed against the arcuate inner wall of the rigid member.

2. Means for lifting and providing mobile support to move a disabled or otherwise handicapped person from a bed or seating to another location, such as a bathroom, said means comprising:

(a) a torso support, said support being formed of (i) a rigid transverse member having a vertical arcuate inner wall and a vertical outer wall terminating laterally in a pair of right angularly joined rearwardly extending planar side walls, said inner wall being dimensioned to extend from one side of the person's body to its other side around the abdominal area, and having a height generally conforming to the altitude of such area;

(ii) a pair of rigid vertical support elements, each being secured to and extending upwardly from one side of the vertical outer wall of said member, each of said vertical elements having extending rearwardly from its upper extremity, and rigidly supporting, an arm parallel to the arm of the other vertical element, each said arm being arcuately recessed downwardly to receive one of the body's arms at its torso connection; and (b) lifting means, said means being pivotally connected at least to the outer wall of said rigid member at the lower rear area of each of said planar side walls of said rigid member, said lifting means including means to prevent said torso support from flipping over about its pivotal connection on said planar side walls, and said lifting means being adapted to provide a force to raise and lower said torso support when the upper torso of a person is disposed therein with its armpits in the arcuate recesses of the arms extending rearwardly from the upper extremities of the vertical elements, and with the abdomen pressed against the arcuate inner wall of the rigid member.

3. The means for lifting and providing mobile support as described in claim 2 wherein the lifting means comprises a U-shaped rigid element fixedly connected to and extending from a rigid lift bar, said bar being pivotally secured to a hydraulically actuable member, thereby to be raised and lowered in response to such actuation, and the projecting arms of the U of the U-shaped rigid element are pivotally secured at their extremities to the lower corners of the rear of the planar side walls of the rigid transverse member.

4. The means for lifting and providing mobile support as described in claim 2 wherein the lifting means comprises an overhead cable which may be raised or lowered in response to control means, the lower end of said cable being connected to the upper extremities of two pairs of flexible elements, the other extremity of one of each of the first of said pairs being pivotally connected to the lower rear area of each of the planar side walls of said rigid member, and the other extremity of one of each of the second pair of flexible elements being connected to the upper area of one of the pair of rigid vertical parallel support elements.

5. The means for lifting and providing mobile support as described in claim 2, wherein each of the rigid vertical parallel support elements is pivotally secured at its lower extremity to the outer vertical wall of said transverse member.

6. The means for lifting and providing mobile support as described in claim 2, wherein the outer vertical wall of the rigid member is provided with means to limit the angles about which the rigid vertical elements may be pivoted in relationship to said outer vertical wall.

7. Means for lifting and providing mobile support to move a disabled or otherwise handicapped person from a bed or seating to another location, such as a bathroom, said means comprising:

(a) a torso support, said support being formed of a rigid, elongated, transverse member extending about a first axis and having an inner vertical wall of a height approximating the height of a person's abdomen, and a pair of arcuate upper arm receiving and supporting elements spaced apart from each other by the width of the chest of the person to be supported, said elements being rigidly positioned and secured to, above and to the rear of the transverse member;

(b) lifting means pivotally secured to the transverse member to permit the latter to swing about an axis parallel to said first axis over a pre-determined angle and to move the torso support in a horizontal direction;

(c) means to actuate said lifting means to elevate said torso support to a pre-determined height, to hold it at such height disposition, to move the torso support horizontally in a predetermined direction, and to lower said torso support to such disposition as may be desired.

8. Means for lifting and providing mobile support to move a disabled or otherwise handicapped person from a bed or seating to another location, such as a bathroom, said means comprising:

(a) a wheeled base (b) means on said base to support an elongated rigid member having its first end hingedly connected to said base and its second end extending upwardly from the base of a pre-determined angle relative to the horizontal, said rigid member being movable between a first position at a first pre-determined angle with reference to the horizontal, and a second position at a second and greater angle with reference to the horizontal;

(c) powdered means to move said elongated rigid member and to hold it in any disposition between said first and second positions;

(d) a rigid transverse member, the last said member being hingedly connected on the second end of said elongated rigid member for limited movement about its hinged axis, said transverse member presenting a vertical wall opposite the hinge connection, said wall being of a height approximating the height of the abdomen of the person to be supported;

(e) a pair of vertical support elements spaced from each other by a distance equal to the width of the chest of the person to be supported, and said elements extending upwardly from said transverse member and fixedly anchored on said member, each of said elements supporting a rearwardly extending arcuate arm adapted to receive the person's arm at the armpit connection with the torso; and (f) control means to actuate said powered means;

whereby when said wall is placed in abutment with the person's abdomen and the person's arms are seated in the arcuate arms, operating the control means to actuate the powered means will enable the person to be raised or lowered from or to any seating position or to provide such supplement support as the person's legs may be incapable of normally providing.

9. Means for lifting and providing mobile support to move a disabled or otherwise handicapped person from a bed or seating to another location, such as a bathroom, said means as described in claim 8 wherein transverse handle means are provided on said elongated rigid member, said handle means being spaced from the hinged connection, whereby the person being lifted may grasp said handle means to provide manual support while being lifted by the torso support means.

* * * * *